US008511990B2

(12) United States Patent
Giri

(10) Patent No.: US 8,511,990 B2
(45) Date of Patent: Aug. 20, 2013

(54) COOLING HOLE EXITS FOR A TURBINE BUCKET TIP SHROUD

(75) Inventor: Sheo Narain Giri, Uttar Pradesh (IN)

(73) Assignee: General Electric Company, Schenectady, NY (US)

( * ) Notice: Subject to any disclaimer, the term of this patent is extended or adjusted under 35 U.S.C. 154(b) by 527 days.

(21) Appl. No.: 12/490,429

(22) Filed: Jun. 24, 2009

(65) Prior Publication Data

US 2010/0329862 A1 Dec. 30, 2010

(51) Int. Cl.
*F01D 5/18* (2006.01)

(52) U.S. Cl.
USPC ..... 416/92

(58) Field of Classification Search
USPC ..... 416/92, 97 R, 195
See application file for complete search history.

(56) References Cited

U.S. PATENT DOCUMENTS

| | | | | |
|---|---|---|---|---|
| 3,816,022 | A * | 6/1974 | Day | 416/92 |
| 4,177,011 | A * | 12/1979 | Eskesen et al. | 416/191 |
| 4,820,480 | A * | 4/1989 | David | 418/153 |
| 4,845,940 | A * | 7/1989 | Beer | 60/732 |
| 4,940,388 | A * | 7/1990 | Lilleker et al. | 416/97 R |
| 5,096,379 | A * | 3/1992 | Stroud et al. | 416/97 R |
| 6,234,754 | B1 * | 5/2001 | Zelesky et al. | 416/97 R |
| 6,390,774 | B1 | 5/2002 | Lewis et al. | |
| 6,761,534 | B1 * | 7/2004 | Willett | 416/97 R |
| 6,910,864 | B2 * | 6/2005 | Tomberg | 416/90 R |
| 6,966,756 | B2 | 11/2005 | McGrath et al. | |
| 6,997,679 | B2 | 2/2006 | Beddard et al. | |
| 7,052,240 | B2 | 5/2006 | Race et al. | |
| 7,303,372 | B2 | 12/2007 | West et al. | |
| 7,351,036 | B2 | 4/2008 | Liang | |
| 2004/0115053 | A1 * | 6/2004 | Shi et al. | 416/97 R |
| 2006/0073017 | A1 * | 4/2006 | Manning et al. | 416/97 R |
| 2006/0099074 | A1 * | 5/2006 | Kopmels | 416/97 R |
| 2008/0008598 | A1 | 1/2008 | Liang | |
| 2008/0080979 | A1 | 4/2008 | Brassfield et al. | |
| 2009/0317258 | A1 * | 12/2009 | Tibbott et al. | 416/97 R |

FOREIGN PATENT DOCUMENTS

| | | | |
|---|---|---|---|
| EP | 207799 | * | 1/1987 |
| WO | 2006/108749 A1 | | 10/2006 |

* cited by examiner

*Primary Examiner* — Edward Look
*Assistant Examiner* — Liam McDowell
(74) *Attorney, Agent, or Firm* — Sutherland Asbill & Brennan LLP

(57) ABSTRACT

A turbine bucket for a gas turbine engine is described herein. The turbine bucket may include an airfoil, a tip shroud positioned on a tip of the airfoil, and a number of cooling holes extending through the airfoil and the tip shroud. One or more of the cooling holes may include a length of narrowing diameter about the tip shroud and a length of expanding diameter about a surface of the tip shroud.

20 Claims, 6 Drawing Sheets

COOLING HOLE EXITS FOR A TURBINE BUCKET TIP SHROUD

TECHNICAL FIELD

The present application relates generally to turbine engines and more particularly relates to cooling holes for a turbine bucket with a convergent-divergent passage about the tip shroud so as to provide improved cooling.

BACKGROUND OF THE INVENTION

Generally described, gas turbine buckets may have a largely airfoil shaped body portion. The buckets may be connected at the inner end to a root portion and connected at the outer end to a tip portion. The buckets also may incorporate a shroud about the tip portion. The shroud may extend from the tip portion so as to prevent or reduce hot gas leakage past the tip. The use of the shroud also may reduce overall bucket vibrations.

The tip shroud and the bucket as a whole may be subject to creep damage due to a combination of high temperatures and centrifugally induced bending stresses. One method of cooling the bucket as a whole is to use a number of cooling holes extending therethrough. The cooling holes may transport cooling air through the bucket and form a thermal barrier between the bucket and the tip shroud and the flow of hot gases.

Although cooling the bucket may reduce creep damage, the use of the air flow to cool the bucket may reduce the efficiency of the turbine engine as a whole due to the fact that this cooling air is not passing through the turbine section. Further, the effectiveness of the cooling air diminishes as the air moves from the bottom to the top of the bucket. This diminished effectiveness may lead to higher temperatures towards the exit of the bucket about the tip shroud due to less cooling.

There is thus a desire for bucket cooling systems and methods that provide adequate cooling to prevent creep and increase bucket life while improving overall turbine performance and efficiency.

SUMMARY OF THE INVENTION

The present application thus describes a turbine bucket for a gas turbine engine. The turbine bucket may include an airfoil, a tip shroud positioned on a tip of the airfoil, and a number of cooling holes extending through the airfoil and the tip shroud. One or more of the cooling holes may include a length of narrowing diameter about the tip shroud and a length of expanding diameter about a surface of the tip shroud.

The present application further describes a method of cooling a turbine bucket. The method may include the steps of flowing air through a number of cooling holes extending through the bucket, flowing the air through a length of narrowing diameter in the cooling holes, and flowing the air through a length of expanding diameter about an outlet of the cooling holes.

The present application further describes a turbine bucket for a gas turbine engine. The turbine bucket may include an airfoil, a tip on an end of the airfoil, and a number of cooling holes extending through airfoil and the tip. One or more of the cooling holes may include a length of narrowing diameter about the tip and a length of expanding diameter about a surface of the tip.

These and other features of the present application will become apparent to one of ordinary skill in the art upon review of the following detailed description when taken in conjunction with the several drawings and the appended claims.

DETAILED DESCRIPTION

Figure 1:
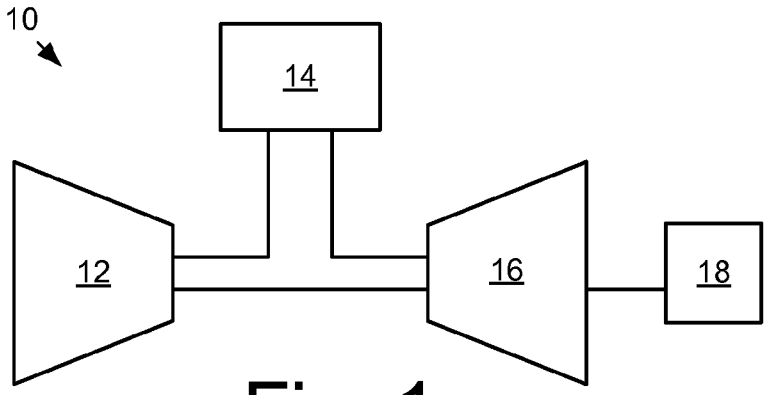
Fig. 1 (PRIOR ART)
FIG. 1 is a schematic view of a gas turbine engine.

Referring now to the drawings, in which like numbers refer to like elements throughout the several views, FIG. 1 shows a schematic view of a gas turbine engine 10. As is known, the gas turbine engine 10 may include a compressor 12 to compress an incoming flow of air. The compressor 12 delivers the compressed flow of air to a combustor 14. The combustor 14 mixes the compressed flow of air with a compressed flow of fuel and ignites the mixture. (Although only a single combustor 14 is shown, the gas turbine engine 10 may include any number of combustors 14.) The hot combustion gases are in turn delivered to a turbine 16. The hot combustion gases drive the turbine 16 so as to produce mechanical work. The mechanical work produced in the turbine 16 drives the compressor 12 and an external load 18 such as an electrical generator and the like. The gas turbine engine 10 may use natural gas, various types of syngas, and other types of fuels. The gas turbine engine 10 may have other configurations and may use other types of components. Multiple gas turbine engines 10, other types of turbines, and other type of power generation equipment may be used herein together.

Figure 2:
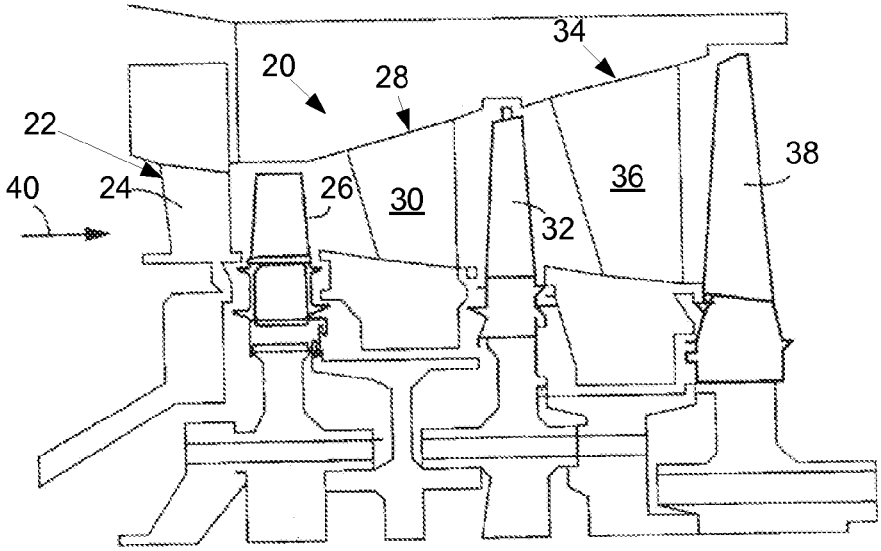
Fig. 2 (PRIOR ART)
FIG. 2 is a schematic view of a number of stages of a gas turbine.

FIG. 2 shows a number of stages 20 of the turbine 16. A first stage 22 includes a number of circumferentially spaced first stage nozzles 24 and buckets 26. Likewise, a second stage 28 includes a number of circumferentially spaced second stage nozzles 30 and buckets 32. Further, a third stage 34 includes a number of circumferentially spaced third stage nozzles 36 and buckets 38. The stages 22, 28, 34 are positioned in a hot gas path 40 through the turbine 16. Any number of stages 20 may be used herein.

Figure 3:
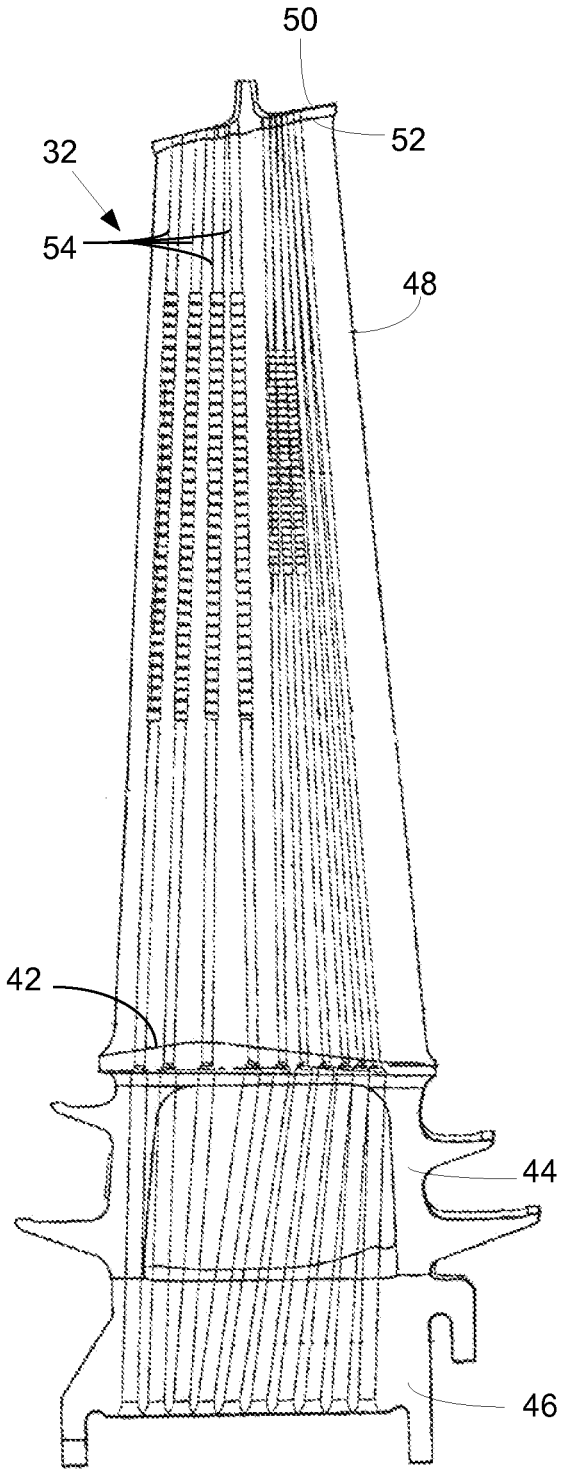
Fig 3 (PRIOR ART)
FIG. 3 is a side cross-sectional view of a turbine bucket.

FIG. 3 shows a side cross-sectional view of the bucket 32 of the second stage 28 of the turbine 16. As is known, each bucket 32 may have a platform 42, a shank 44, and a dovetail 46. An airfoil 48 may extend from the platform 42 and ends in a tip shroud 50 about a tip 52 thereof. The tip shroud 50 may be integrally formed with the airfoil 48. Other configurations are known.

Figure 4:
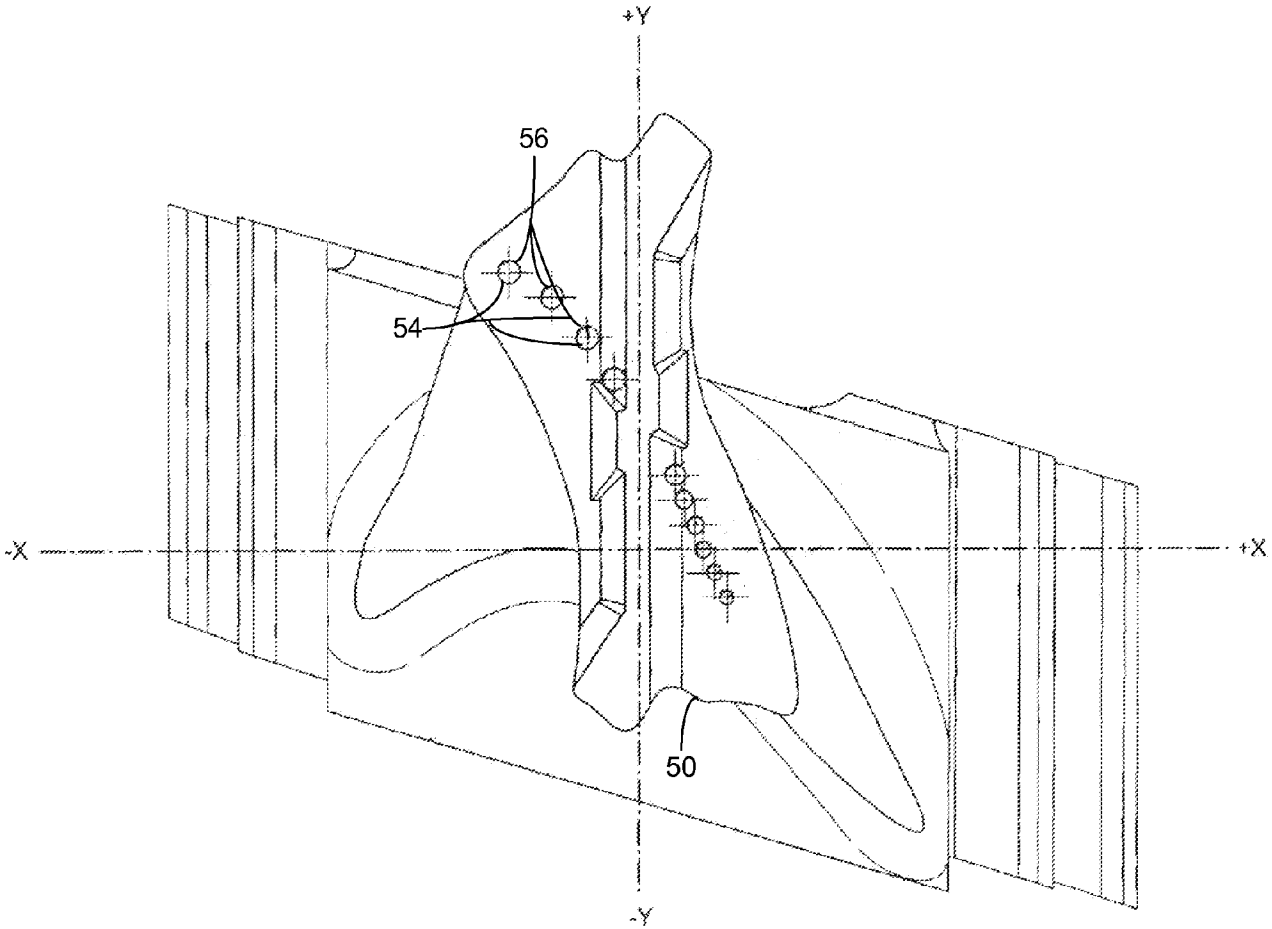
Fig 4 (PRIOR ART)
FIG. 4 is a top plan view of a turbine bucket tip shroud.
Figure 5:
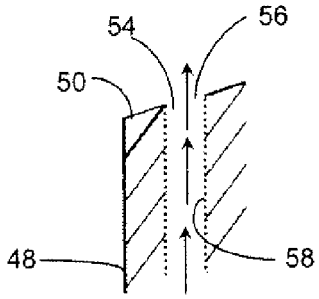
Fig 5 (PRIOR ART)
FIG. 5 is a side cross-sectional view of a known cooling hole exit.

Each bucket 32 may have a number of cooling holes 54 extending between the dovetail 46 and the tip shroud 50 of the tip 52 of the airfoil 48. As is shown in FIG. 4, the cooling holes 54 may have outlets 56 that extend through the tip shroud 50. As such, the cooling medium, e.g., air from the compressor 12, may pass through the cooling holes 54 and exit about the tip 52 of the airfoil 48 through the outlets 56 and into the hot gas path 40. As is shown in FIG. 5, the outlets 56 are generally circular in shape and generally have a straight wall 58 therethrough with a relatively constant diameter. Other configurations may be used.

Figure 6:
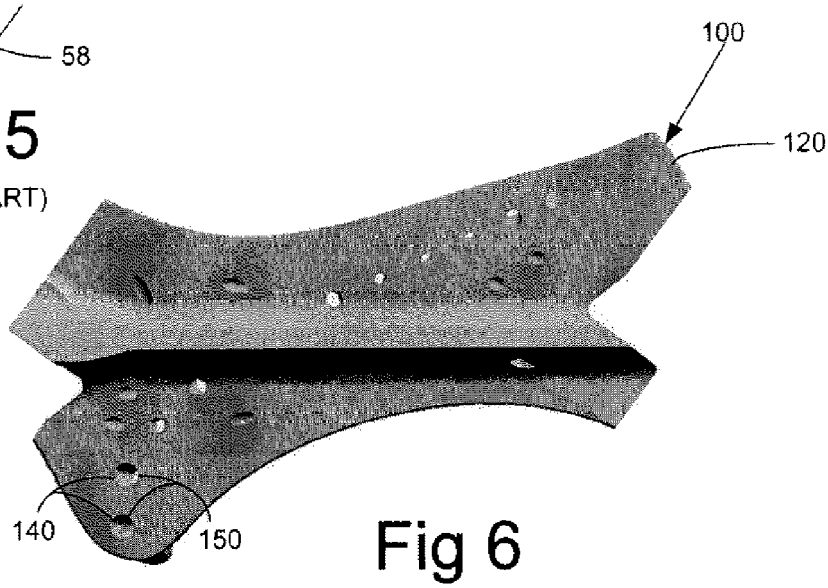
FIG. 6 is a top plan view of a turbine bucket tip shroud with a number of cooling hole exits as are described herein.
Figure 7:
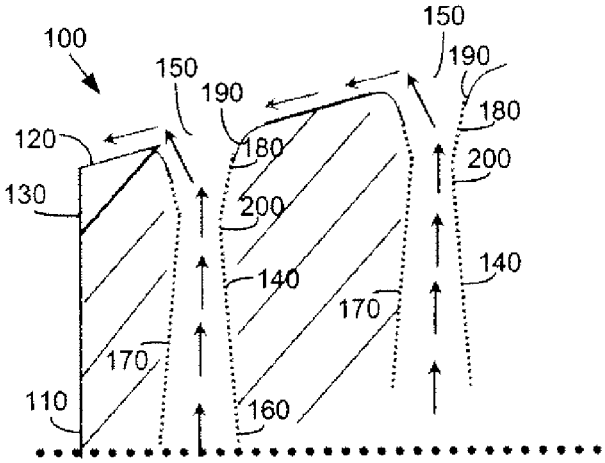
FIG. 7 is a side cross-sectional view of the cooling hole exits of FIG. 6.
Figure 8A:
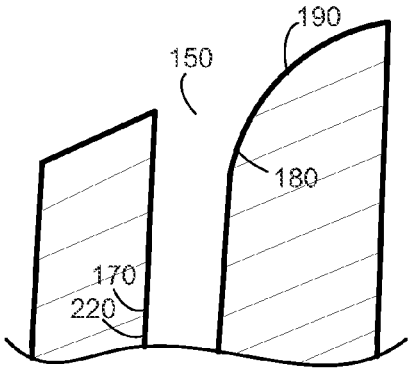
FIG. 8A is a side cross-sectional view of an alternative embodiment of a cooling hole exit as is described herein.
Figure 8B:
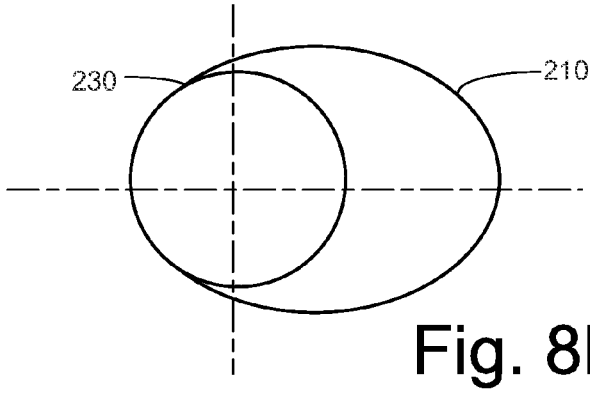
FIG. 8B is a top plan view of the cooling hole exit of FIG. 8A.
Figure 9A:
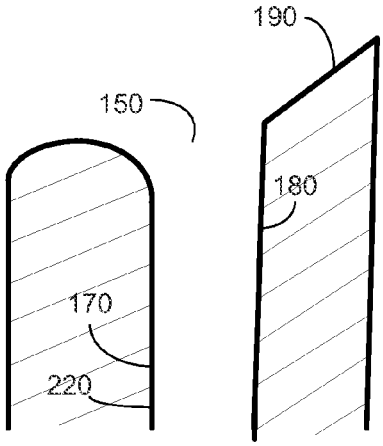
FIG. 9A is a side cross-sectional view of an alternative embodiment of a cooling hole exit as is described herein.
Figure 9B:
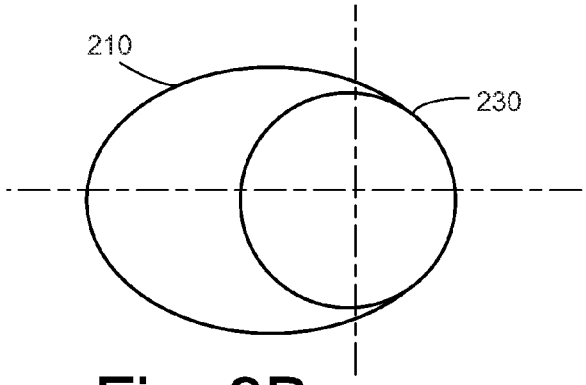
FIG. 9B is a top plan view of the cooling hole exit of FIG. 9A.

FIGS. 6 and 7 show a turbine bucket 100 as is described herein. The turbine bucket 100 includes an airfoil 110 that extends to a tip shroud 120 at a tip 130 thereof. The turbine bucket 100 may include a number of cooling holes 140 extending therethrough. Any number of cooling holes 140 may be used herein. The cooling holes 140 may extend to an outlet 150 about the tip shroud 120. The cooling holes 140 may have a largely constant diameter 160 through the airfoil 110.

The cooling holes 140 may have a convergent path or a length of narrowing diameter 170 positioned about the tip shroud 120. The cooling holes 140 then may take an expanding path or a length of expanding diameter 180 towards a surface 190 of the outlet 150. The length of the narrowing diameter 170 may be longer than the length of the expanding diameter 180. The lengths 170, 180 may vary. The narrowing diameter 170 and the expanding diameter 180 may meet at a neck 200. The neck 200 may be about 100 to 300 mils (about 2.54 to 7.62 millimeters) below the surface 190 of the tip shroud 120. The depth, size, and configuration of the cooling holes 140 through the outlet 150 and elsewhere may vary herein.

The use of the convergent path or the length of narrowing diameter 170 helps to increase the heat transfer coefficient at the outlet 150 of the tip shroud 120. The heat transfer coefficient increases with the same mass flow rate due to an increased velocity through the convergent shape. Calculations using the Dittus-Boelter Correlation (Forced Convection) show that there may be an increased heat transfer coefficient of about 16%. The resultant heat transfer coefficient may vary due to the size and shape of the cooling holes 140, the mass flow rate therethrough, the fluid viscosity, and other variables.

Likewise, the use of the divergent path or the length of expanding diameter 180 at the surface 190 provides a strong recirculation to form film layer cooling so as to provide additional cooling to the tip shroud 120. This flow increases the coefficient of discharge and reduces the blow off near the surface 190. The recirculation may flow at about 120 feet per second (about 36.6 meters per second). The flow rate may vary herein.

The improved cooling provided herein should result in a longer lifetime for the turbine bucket 100 as a whole. Specifically, the combination of the narrowing diameter 170 and the expanding diameter 180 increase the cooling effectiveness at the surface 190 by forming a film layer over the surface of the tip shroud 120 and also by increasing the heat transfer coefficient.

Figure 10A:
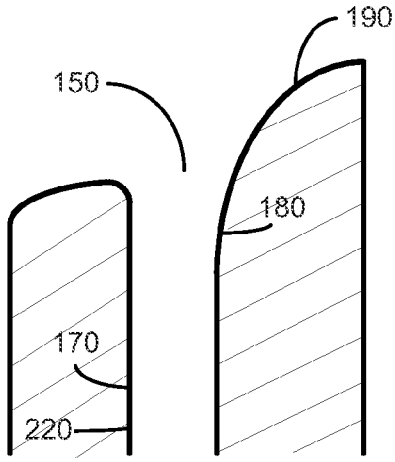
FIG. 10A is a side cross-sectional view of an alternative embodiment of a cooling hole exit as is described herein.
Figure 10B:
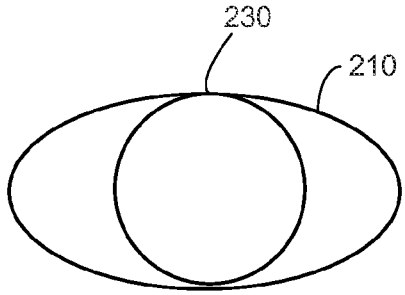
FIG. 10B is a top plan view of the cooling hole exit of FIG. 10A.
Figure 11A:
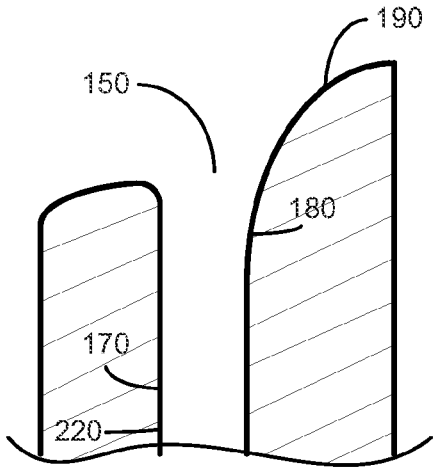
FIG. 11A is a side cross-sectional view of an alternative embodiment of a cooling hole exit as is described herein.
Figure 11B:
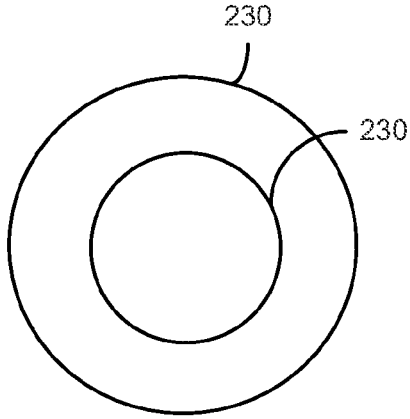
FIG. 11B is a top plan view of the cooling hole exit of FIG. 11A.

As is shown in FIGS. 8A-8B and 9A-9B, the length of expanding diameter 180 may take a largely oval shape 210 while the length of narrowing diameter 170 may have a largely cone-like shape 220 with a largely circular cross-section 230. The narrowing diameter 170 may be positioned about either side of the expanding diameter 180. Other types of offset positions may be used herein. Likewise, as is shown in FIGS. 10A-10B, the narrowing diameter 170 may be positioned in the middle of the expanding diameter 180. As is shown in FIGS. 11A-11B, the expanding diameter 180 also may take a largely circular shape 230. Other shapes, positions, and configurations may be used herein.

It should be understood that the foregoing relates only to the preferred embodiments of the present application and that numerous changes and modifications may be made herein by one of ordinary skill in the art without departing from the general spirit and scope of the invention as defined by the following claims and the equivalents thereof.

I claim:

1. A turbine bucket, comprising:

an airfoil;

a tip shroud positioned on a tip of the airfoil; and a plurality of cooling holes extending radially through the airfoil and the tip shroud;

one or more of the plurality of cooling holes comprising a length of narrowing diameter about the tip shroud and a length of expanding diameter about a surface of the tip shroud, wherein the length of narrowing diameter is disposed about a radially inner portion relative to the length of expanding diameter, wherein the length of narrowing diameter is greater than the length of expanding diameter, and wherein a central axis of the length of narrowing diameter is offset from and parallel to a central axis of the length of expanding diameter.

2. The turbine bucket of claim 1, wherein the one or more of the plurality of cooling holes comprise a neck between the length of narrowing diameter and the length of expanding diameter.

3. The turbine bucket of claim 1, wherein the length of expanding diameter comprises a substantially oval shaped cross-section.

4. The turbine bucket of claim 1, wherein the length of expanding diameter comprises a substantially circular shaped cross-section.

5. The turbine bucket of claim 1, wherein the length of narrowing diameter comprises a substantially oval shaped cross-section.

6. The turbine bucket of claim 1, wherein the length of narrowing diameter comprises a substantially circular shaped cross-section.

7. The turbine bucket of claim 1, wherein the turbine bucket comprises a stage two bucket.

8. The turbine bucket of claim 1, wherein the length of narrowing diameter comprises a substantially circular shaped cross-section, and wherein the length of expanding diameter comprises a substantially oval shaped cross-section.

9. The turbine bucket of claim 1, wherein the length of narrowing diameter comprises a substantially oval shaped cross-section, and wherein the length of expanding diameter comprises a substantially circular shaped cross-section.

10. A method of cooling a turbine bucket, comprising:

flowing air through a plurality of cooling holes extending radially through the bucket;

flowing the air through a length of narrowing diameter in the plurality of cooling holes; and flowing the air through a length of expanding diameter about an outlet of the plurality of cooling holes, wherein the length of narrowing diameter is disposed about a radially inner portion relative to the length of expanding diameter, wherein the length of narrowing diameter is greater than the length of expanding diameter, and wherein a central axis of the length of narrowing diameter is offset from and parallel to a central axis of the length of expanding diameter.

11. The method of cooling of claim 10, wherein the step of flowing the air through the length of narrowing diameter comprises accelerating the air.

12. The method of cooling of claim 10, wherein the step of flowing the air through the length of narrowing diameter comprises increasing the heat transfer coefficient therethrough.

13. The method of cooling of claim 10, wherein the step of flowing the air through the length of expanding diameter comprises increasing the coefficient of discharge therethrough.

14. The method of cooling of claim 10, wherein the step of flowing the air through the length of expanding diameter comprises creating a recirculation flow about a tip of the bucket.

15. The method of claim 10, wherein the length of narrowing diameter comprises a substantially circular shaped cross-section, and wherein the length of expanding diameter comprises a substantially oval shaped cross-section.

16. A turbine bucket, comprising:

an airfoil;

the airfoil comprising a tip at one end thereof; and a plurality of cooling holes extending radially through the airfoil and the tip;

one or more of the plurality of cooling holes comprising a length of narrowing diameter about the tip and a length of expanding diameter about a surface of the tip, wherein the length of narrowing diameter is disposed about a radially inner portion relative to the length of expanding diameter, wherein the length of narrowing diameter is greater than the length of expanding diameter, and wherein a central axis of the length of narrowing diameter is offset from and parallel to a central axis of the length of expanding diameter.

17. The turbine bucket of claim 16, further comprising a tip shroud positioned about the tip.

18. The turbine bucket of claim 16, wherein the turbine bucket comprises a stage two bucket.

19. The turbine bucket of claim 16, wherein the length of narrowing diameter comprises a substantially circular shaped cross-section, and wherein the length of expanding diameter comprises a substantially oval shaped cross-section.

20. The turbine bucket of claim 16, wherein the length of narrowing diameter comprises a substantially oval shaped cross-section, and wherein the length of expanding diameter comprises a substantially circular shaped cross-section.

* * * * *